US006173637B1

(12) United States Patent
Hubert et al.

(10) Patent No.: US 6,173,637 B1
(45) **Date of Patent: *Jan. 16, 2001**

(54) MOLDING CUTTER HEAD

(75) Inventors: Normand P. Hubert; Ralph L. Hubert, both of West Hills, CA (US)

(73) Assignee: LRH Enterprises, Inc., Van Nuys, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/135,285

(22) Filed: Aug. 17, 1998

(51) Int. Cl.[7] ..... B26D 1/12
(52) U.S. Cl. ..... 83/698.41; 83/842; 83/845
(58) Field of Search ..... 83/836, 842, 843, 83/840, 839, 838, 698.41; 144/218, 229, 230, 241; 407/33, 34, 46

(56) References Cited

U.S. PATENT DOCUMENTS

| | | | | |
|---|---|---|---|---|
| 1,728,264 | * | 9/1929 | England | 144/46 |
| 1,831,705 | * | 11/1931 | Freas | 83/842 |
| 3,071,027 | * | 1/1963 | Hiltebrand | 83/840 |
| 3,134,412 | * | 5/1964 | Schmitt | 144/218 |
| 3,199,799 | * | 8/1965 | Sybertz | 144/218 |
| 3,776,289 | * | 12/1973 | Boboltz et al. | 407/46 |
| 4,667,713 | * | 5/1987 | Wright | 83/842 |
| 4,692,069 | * | 9/1987 | Kieninger | 407/46 |
| 4,885,968 | * | 12/1989 | Tuomaala | 83/843 |
| 5,092,212 | * | 3/1992 | Pawlosky | 83/845 |
| 5,558,142 | * | 9/1996 | Ehrle et al. | 407/46 |

FOREIGN PATENT DOCUMENTS

| | | | | |
|---|---|---|---|---|
| 2007378 | * | 1/1970 | (FR) | 83/698.41 |
| 195215 | * | 3/1965 | (SE) | 83/698.41 |
| WO94/07665 | * | 4/1994 | (WO) | 144/218 |

* cited by examiner

*Primary Examiner*—M. Rachuba
*Assistant Examiner*—Omar Flores-Sánchez
(74) *Attorney, Agent, or Firm*—Elliott N. Kramsky

(57) ABSTRACT

A tool for cutting a predetermined molding pattern into a work piece as it is longitudinally advanced. A molding head is adapted to be mounted to the output shaft of a motor. The head is generally-circular and includes at least one arcuate cutout in its peripheral edge for receiving a generally-circular cutter unit. The arcuate cutout is greater than semicircular so that the center of the unit lies within the peripheral edge and is therby protected from radial travel. A bayonet-type fixture and an alognment screw are provided for engaging the cutter unit to the molding head whereby multiple devices protect the operator from violent disengagement of the cutter unit from the head during high speed cutting.

2 Claims, 2 Drawing Sheets

MOLDING CUTTER HEAD

BACKGROUND

1. Field of the Invention

The present invention relates to apparatus for coupling to the output shaft of a high speed drive motor and holding cutter bits that are caused to rotate at high rates of rotation with respect to a longitudinally-advanced work piece. More particularly, this invention pertains to a molding head, including peripheral cutter units, that provides multiple mechanisms for securing the cutter units against dislodgement during use.

2. Description of the Prior Art

The manufacture of molding generally involves the use of bits of predetermined cutting profile that are secured to rotatable cutting heads. A wood work piece is longitudinally advanced with respect to the cutting head, which is driven at high r.p.m. by the output shaft of an electric motor. The head is generally of symmetrical planar shape and includes means for accommodating at least one cutting bit at its periphery to engage the work piece as it is advanced.

The work environment, commonly involving motor speeds of up to 6000 r.p.m., is inherently subject to vibration. As the work piece is often advanced by hand, the operator is usually close at hand and numerous factors can subject him to danger. Generally, the cutting bits are formed separately from the head to permit their replacement with bits suitable for forming alternative cutting patterns. Due to the presence of high motor speeds and vibration, such bits must be safely secured against dislodgement in the presence of the centrifugal forces generated which have the potential to launch an object with sufficient speed to kill or maim. Another as danger can arise when the workpiece is manually advanced too rapidly with respect to the rotating head and bits.

An example of a prior art molding cutter head of the above-described type is illustrated in U.S. Pat. Ser. No. 2,731,991 of Cowley entitled "Molding Head With Cutter" and illustrated in FIG. 1. The plate-like head 10 is generally-symmetrical about a central aperture for receiving the output shaft of a drive motor and is mounted for clockwise rotation when oriented as shown in FIG. 1. It includes three equiangularly-spaced lobes 14, 16 and 18 for receiving and securing cutter bits 20, 22 and 24 respectively within edge slots 20', 22' and 24'. Bores within the lobes 14, 16 and 18 are arranged to receive bolts 20", 22" and 24" at the straight portions of the lobe profiles. The head 10 relies upon geometrical relationships between the slots and the bolts to overcome and, in fact, to utilize the centrifugal forces inherent in the rotation of the head to secure the bits 20, 22 and 24 from dislodging and flying outwardly during operation.

The reliance upon specific geometrical relationships between the bores for receiving the bolts and the slots for receiving the bits mandates the use of the lobed structure of the head 10. In use, driven at high rotation speeds, the straight edge portions of the lobes, which rotate in advance of their arcuate sections, tend to entrap air, thereby increasing vibration. Further, as the bits 20, 22 and 24 are each secured by a single bolt, each must be carefully tightened when changing bits. Thus, the careless operation of such a head can easily result in serious injury.

SUMMARY OF THE INVENTION

The present invention addresses the foregoing and other shortcomings of the prior art by providing apparatus for cutting a predetermined profile into a work piece. Such apparatus includes a generally-circular planar molding head. At least one generally-circular planar cutter unit is provided. The head has an arcuate aperture adjacent its periphery adapted to receive the cutter unit. Means are provided for fixing the cutter unit within the aperture. The arcuate aperture defines a greater-than-semicircular arc whereby the center of the generally-circular cutter unit lies within the periphery of the head.

The preceding and other features and advantages of the present invention will become further apparent from the detailed description that follows. Such description is accompanied by a set of drawing figures. Numeral of the drawing figures point to the features of the invention with like numerals of the written description and the drawing figures referring to like features throughout.

DETAILED DESCRIPTION OF THE PREFERRED EMBODIMENT

Figure 1:
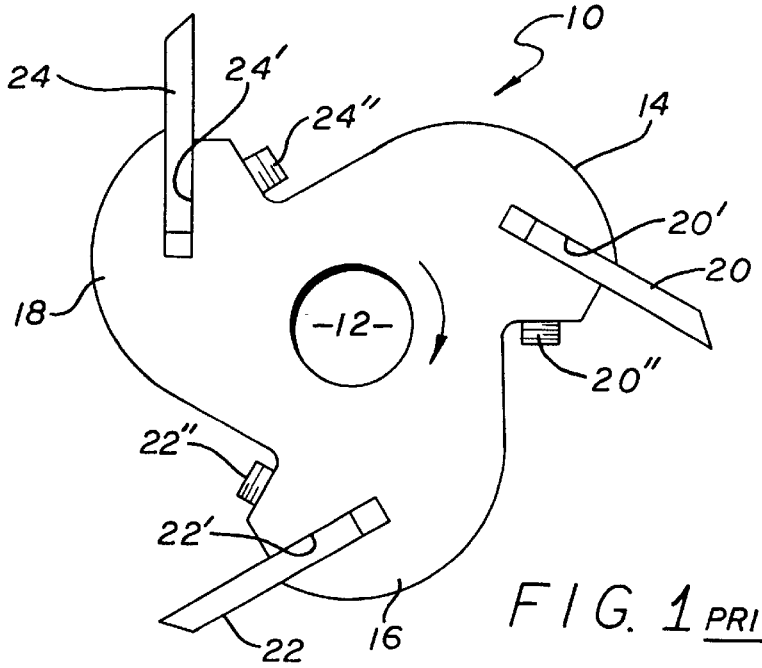
FIG. 1 PRIOR ART
FIG. 1 is a side elevation view of a prior art cutting head generally in accordance with U.S. Pat. No. 2,731,991.
Figure 2:
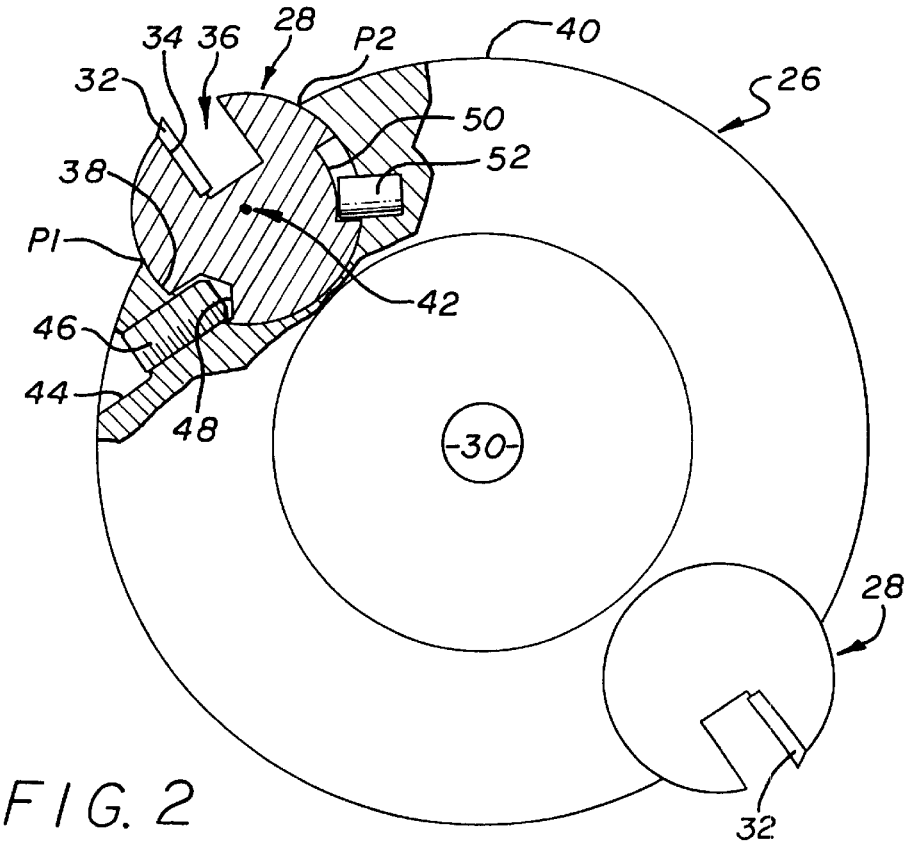
FIG. 2 is a side elevation view of the invention partially in section for illustrating the major components thereof.

FIG. 2 is a side elevation view of the invention partially in section. The apparatus of the invention generally includes a plate-like, generally circular molding head 26 and at least one cutter unit 28 coupled thereto. The head 26 has a central aperture 30 for receiving the output shaft of a drive motor (not shown). Conventional means are provided for securely affixing the head 26 to the output shaft at the aperture 30.

Each of the cutter units 28 is planar and generally circular. A cutting bit 32 of predetermined cutting profile is fixed to the rear wall 34 of a radially-extending slot 36 of each cutter unit 28. (Note, the molding head 26 is mounted to rotate in a clockwise direction with respect to the configuration illustrated in FIG. 2.) The bit 32 is preferably welded to the rear wall 34 to provide secure affixation. In use, the cutter units 28 are identical and therefore interchangeable with bits of differing cutting profiles affixed to pairs of cutting units. In this way, the tool may be converted from one molding profile to another by the replacement of cutter units in pairs as described below.

Each of the cutter units 28 is received within an arcuate cutout 38 that intersects the periphery 40 of the molding head 26. It is a feature of the invention that the arcuate cutout 38 spans greater than a semicircular portion of the periphery of the generally-circular cutting unit 28. As such, the center 42 of rotation of the unit 28 lies within the periphery 40 and the opening in the periphery 40 (defined by the minor arc separating the points "p1" and "p2") is less than the diameter of the cutting unit 28. This "narrowing" of the cutout at the periphery 40 prevents the cutting unit 28, when inserted, from disengaging from the molding head 26U response to centrifugal forces resulting from the high speed rotation thereof. Unlike the cutting head of U.S. Pat. No. 2,731,991, such resistance to centrifugal force is not dependent upon the tightening of a bolt. Rather, the cutting head 28 cannot attain a suitable configuration for operation without engaging such safety feature.

Additional safety features may be observed in FIG. 2. A recessed bore 44 is provided in the moding head 26 for receiving an alignment screw 46. An indentation 48 within the periphery of the cutter unit 28 is arranged to receive the end of the screw 46 to thereby properly orient the unit 28 for cutting purposes. That is, the indentation 48 is located so that the screw 46 sets the slot 36 of the cutter unit 28 so that the cutting angle of the bit 32 is properly-inclined. Unlike the appartus of the prior art, however, safe operation of the device of the present invention is not compromised by the failure of operator to secure the cutter unit 28 properly with the screw 46. While such an oversight may result in an output of inferior quality, this will not endanger the safety of the operator prior to correction of the oversight.

A slot 50 at the opposed peripheral side of the cutter unit 28 receives a pin 52 that is fixed to the molding head 26 and protrudes inwardly of the arcuate cutout 38. It will be seen below that the pin 52 and the slot 50 form a bayonet-type fitting that is necessarily engaged when one fixes the cutter unit 28 to the molding head 26. Such unaviodable engagement of the pin 52 to the slot provides an additional "fail-safe" feature of the invention that enhances operator safety.

Figure 3:
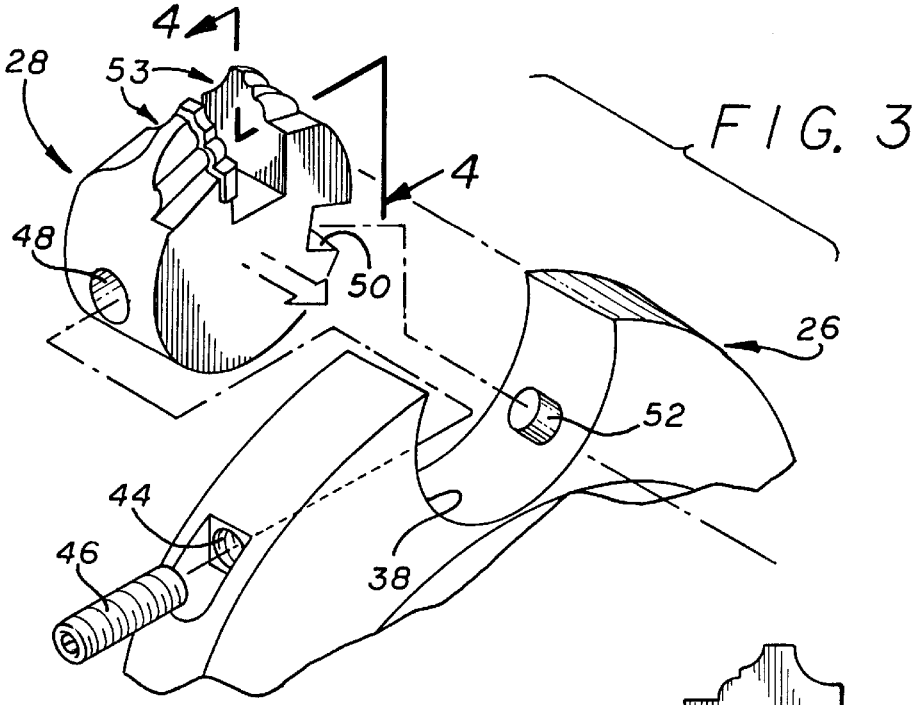
FIG. 3 is an exploded perspective view for illustrating the mechanisms for fixing a cutter unit to the molding head.

The arrangement of the mechanisms for affixing and aligning the cutter unit with respect to the molding head 26 are made further apparent in the exploded perspective view of FIG. 3. It may be further noted from this figure that the region 53 of the cutting unit 28 adjacent the wall 34 is machined to match the cutting profile of the bit 32, thereby adding to the stability of the cuttting member. Such pattern is continued at the opposite side of the slot 36 to assist the operator in regulating the speed at which the workpiece is advanced during the cutting process. A "chip limiter", discussed below, that cooperates with the pattern molded into the leading edge of the slot is incorporated into the invention. This enhances the quality of the molding product formed by a device in accordance with the invention.

Figure 4:
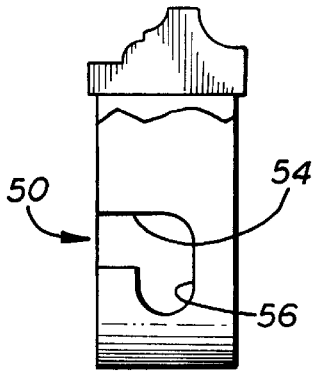
FIG. 4 is a side elevation view of a cutter unit taken at line 4—4 of FIG. 3 for illustrating the bayonet aperture for securing the cutter unit to the head.
Figure 5:
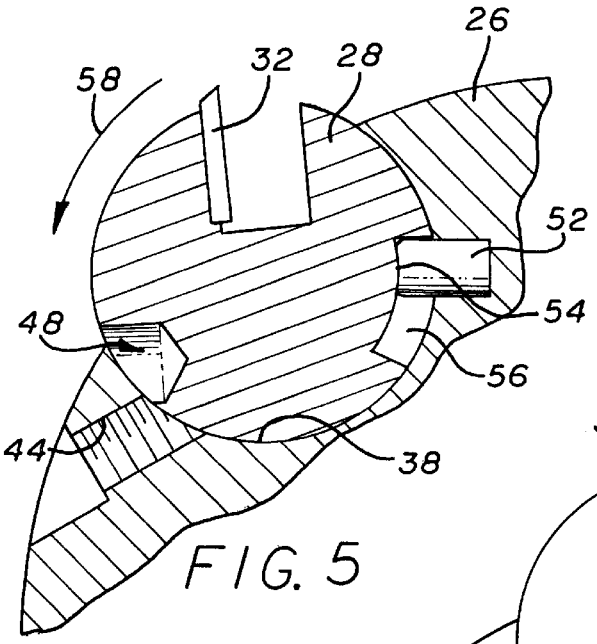
FIG. 5 is a detailed sectional view of the cutter unit and molding head for illustrating the manner in which the cutter unit is locked to the head upon insertion and without bolting.

FIG. 4 is a rear peripheral view of the cutter unit 28 taken at line 4—4 of FIG. 3 for illustrating the slot 50 of the bayonet fixture for securing the cutter unit 28 to the molding head 26. As shown, the slot 50 comprises a horizontal edge portion 54 that leads to an internal vertical portion 56. The manner in which the cutter unit is locked to the head 26 upon insertion is illustrated in FIG. 5, a detailed sectional view of the cutter unit 28 and molding head for illustrating the manner in which the cutter unit is locked to the head upon insertion and without bolting. Referring to FIGS. 4 and 5 in combination, it may be noted that the cutter unit 28 is initially mated with the molding head 26 by aligning the pin 52 fixed to the head 26 which protrudes within the cutout 38 with the horizontal portion 54 of the slot 50 and pressing upon the planar surface of the unit 28 until it is coplanar with the corresponding surface of the plate-like head 26. (It is to be noted that the cutting unit 26 and the molding head 26 are preferably of the same thichness.) This produces the configuration illustrated in FIG. 5 in which the pin 52 is seated at the top of the slot 50 within the horizontal portion 54 and the bore 44 of the head 26 is misaligned with the indentation 48 of the unit 28. An arrow 58 indicates the next assembly step. That is, the cutter unit 28 is then rotated counterclockwise as shown within the cutout 38 to obtain alignment of the bore 44 with the indentation 48. This permits one to insert (or tighten) the screw 44 to secure the desired alignment of the cutter unit 28 with respect to the molding head 26.

In addition to achieving and securing proper alignment of the cutter head 28 (and, therfore, proper alignment of the bit 32), rotation of the head in the direction 58 fully seats the pin 52 at the bottom of the vertical portion 56 of the slot 50. Once the head 26 is rotated, centrifugal force assures that the pin 52 will remain seated against the bottom of the vertical portion 56 and, as the vertical portion 56 is offset from the opposed surfaces of the planar cutter unit 28, axial dislodgement of the unit 28 is made impossible. The "locked" positions of the pin 52 and the screw 44 are indicated by shadow outline in FIG. 6, a detailed side elevation view of the invention in its full secured configuration. Thus, it is seen that the invention provides four distinct arrangements (the integration of the bit 32 into the cutter unit 28, the greater-that-semicircular arcuate cutout 38, the bayonet fixture comprising the slot 50 and the pin 52 and the screw 44) for assuring the safety of the operator against launching of a portion of the tool during high speed operation. In addition, unlike the prior art device described above, the tool of the invention provides no exterior straight surfaces capable of generating turbulence and thereby increasing vibration.

Figure 6:
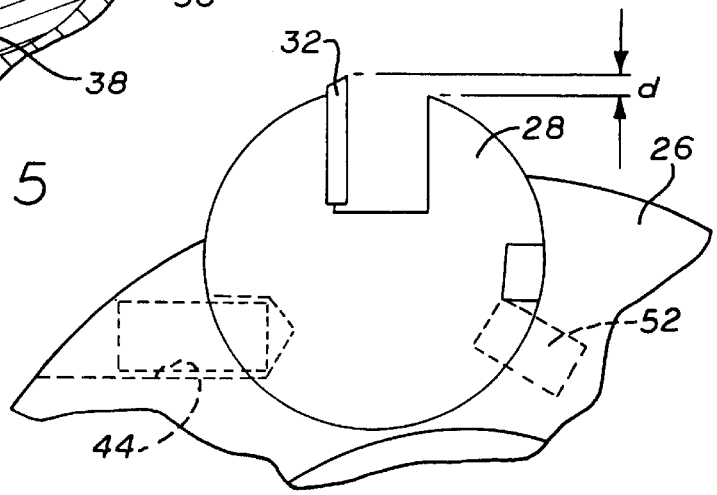
FIG. 6 is a detailed side elevation view of the invention for illustrating the chip limiter feature thereof.

As may also be seen in FIG. 6, when aligned within the head 26, there exists a vertical differential "d" between the leading edge of the slot 36 and the top of the bit 32. Preferably the differential d is on the order of one millimeter. This provides an additional safety feature, a so-called "chip limiter". In operation, the rotating tool of the invention is generally mounted so that only a small percentage is eposed above the working surface or table. The operator advances the workpiece along such surface in a direction opposite to the direction of travel of the cutter units and bits slightly above the surface of the table. (In the present case in which the molding head 26 is rotated clockwise, the workpiece would be advanced from right to left.) The e pattern is cut into the work piece through the sequential "bites" taken by the rapidly-moving bits 32. When moved at an appropriate speed relative to the speed of rotation of the head 26, a smooth cutting process results from multiple sequential bites gradually eating away undesired material from the work piece. However, in the event that the operator should attempt to advance the workpiece too fast the rapidly moving bit may encounter an insufficiently-eroded portion. By providing a vertical differential the workpiece will be pushed upwardly and away from the rotating bit is such case rather than encountering the insufficiently-eroded portion with potentially great from that could make it fly out of the operator's hand as a projectile. Alternatively, the instantaneous removal of the workpiece from the operator's hands might expose the hand to the cutting surface of the rapidly rotating tool. In contrast, the gentle upward inclination of the workpiece lets the operator know that the piece has been advanced too rapidly for the cutting speed without hazard.

Thus it is seen that the present invention provides apparatus for enhancing operator safety during the production of molding. By employing the teachings of this invention, one may take comfort in the fact that multiple devices are incorporated into the tool of the invention to assure operator safety.

While the present invention has been described with reference to its presently-preferred embodiment, it is not limited thereto. Rather, this invention is limited only insofar as it is defined by the following set of patent claims and includes within its scope all equivalents thereof.

What is claimed is:

1. Apparatus for cutting a predetermined profile into a work piece comprising, in combination:

a) a generally-circular planar molding head;

b) at least one generally-circular planar cutter unit;

c) said head having at least one arcuate aperture adjacent its periphery adapted to receive a cutter unit;

d) means for fixing a cutter unit within said aperture, said means including (i) a pin fixed to said molding head and extending into the interior of said arcuate aperture and (ii) a slot within a peripheral edge of a cutter unit located to coact with said pin;

e) said slot including a horizontal slot portion and a vertical slot portion, said vertical slot portion being internal to the periphery of a cutter unit;

f) the opposed ends of said horizontal slot portion intersecting a planar surface of a cutter unit and the top of said vertical slot portion; and g) said arcuate aperture for receiving a generally-circular planar cutting unit being greater than 180 degrees whereby the center of a generally-circular cutter unit lies within the periphery of said head.

2. Apparatus as defined in claim 1 wherein said means for fixing a cutter unit within said aperture further includes:

a) a recessed threaded bore within the periphery of said molding head for receiving a screw;

b) said bore extending to said arcuate aperture;

c) an indentation within the periphery of said cutter unit; and d) said bore, said screw and said indentation being arranged so that said screw may lock a cutter unit into a preferred alignment with respect to said molding head.

* * * * *